US005982908A

United States Patent [19]

Bauman

[11] Patent Number: 5,982,908

[45] Date of Patent: Nov. 9, 1999

[54] EAR WAX COLLECTION DEVICE FOR A HEARING AID

[76] Inventor: Natan Bauman, 625 Redstone Dr., Cheshire, Conn. 06410

[21] Appl. No.: 08/995,641

[22] Filed: Dec. 22, 1997

[51] Int. Cl.[6] ..... H04R 25/00

[52] U.S. Cl. ..... 381/325; 381/328; 381/324

[58] Field of Search ..... 381/312, 322, 381/324, 325, 328, 60; 181/129, 130, 135

[56] References Cited

U.S. PATENT DOCUMENTS

| | | | |
|---|---|---|---|
| 4,349,082 | 9/1982 | Gastmeier | 181/130 |
| 4,553,627 | 11/1985 | Gastmeier et al. | 381/325 |
| 4,763,752 | 8/1988 | Haertl et al. | 381/328 |
| 4,800,982 | 1/1989 | Carlson . | |
| 4,867,267 | 9/1989 | Carlson . | |
| 4,870,689 | 9/1989 | Weiss . | |
| 4,879,750 | 11/1989 | Nassler | 381/325 |
| 4,945,569 | 7/1990 | Kulman . | |
| 4,984,277 | 1/1991 | Bisgaard et al. . | |
| 4,987,597 | 1/1991 | Haertl | 381/325 |
| 5,099,947 | 3/1992 | Guggenberger et al. . | |
| 5,105,904 | 4/1992 | Olsen . | |
| 5,278,360 | 1/1994 | Carbe et al. . | |
| 5,293,008 | 3/1994 | Danielsen . | |
| 5,401,920 | 3/1995 | Oliveira . | |
| 5,535,282 | 7/1996 | Luca . | |

*Primary Examiner*—Huyen D. Le
*Attorney, Agent, or Firm*—Bachman & LaPointe, P.C.

[57] ABSTRACT

An in-the-ear hearing aid in accordance with the present invention has a housing shaped to fit within a user's ear, and a sound passageway within the housing. The sound passageway includes a fixed tube communicating with a receiver. The sound passageway further includes a removable tube whose interior end abuts the fixed tube and an ear wax trap adjacent the interior end. In a preferred embodiment, the ear wax trap is formed from a mesh material. In accordance with the present invention, the removable tube with its integral ear wax trap may be removed as needed to clean the trap. After cleaning, the removable tube with its ear wax trap may be reinserted into the hearing aid.

14 Claims, 1 Drawing Sheet

EAR WAX COLLECTION DEVICE FOR A HEARING AID

BACKGROUND OF THE INVENTION

The present invention relates to an in-the-ear device for collecting cerumen (ear wax), attached to a hearing aid such that it can be easily removed from the hearing aid for cleaning and then easily reinstalled by the hearing aid user.

Modern hearing aids are designed to be worn in the ear of the user. These hearing aids have relatively small passageways for conducting sound. Excretions, referred to as cerumen or ear wax, from the ear tend to enter these passageways and build-up, ultimately blocking all or part of the sound passageway. If left alone, the build-up of the cerumen or ear wax can cause a serious malfunction of the hearing aid. In such cases, the hearing aid needs to be sent for repair with significant inconvenience to the user.

The patent literature contains a number of different devices for dealing with this problem. For example, U.S. Pat. Nos. 4,800,982 and 4,867,267, both to Carlson, illustrate an in-the-ear hearing aid having a cleaning passage which is accessible from outside of the hearing aid housing and which connects to the inner end of the sound outlet passage. Internal cleaning of the hearing aid is effected by pumping a solvent through a conduit formed by the cleaning passage, an acoustic chamber, and a sound outlet passage.

U.S. Pat. No. 4,984,277 to Bisgaard et al. and U.S. Pat. No. 5,401,920 to Oliveira illustrate the use of filter elements in a hearing aid. The Bisgaard et al. patent illustrates a hearing aid having an exchangeable, external filter element which snaps onto a sound conduction tube. The Oliveira patent illustrates a disposable wax guard affixed over the sound outlet port of a hearing aid, which guard is adhered to sides of the hearing aid. The portion of the guard which overlies the sound outlet port is configured to be porous to sound and receptive to cerumen.

U.S. Pat. No. 4,945,569 to Kulman relates to an ear wax-protective device having a yoke joined to an auditory passage portion of a hearing aid. Supposedly, this arrangement makes it possible to easily remove accumulations of earwax without damaging sensitive electrical components in the hearing aid.

U.S. Pat. No. 5,099,947 to Guggenberger et al. illustrates a wax guard for hearing aids. The wax guard is in the form of a coil of wire which is interference fitted within the receiver to provide a restrictive path for ear wax.

U.S. Pat. No. 5,278,360 to Carbe et al. relates to a wax guard system having a housing secured to the hearing aid shell and an insert which screws into the housing. The insert has a body having an internal passage therethrough and a bridge extending across the exterior opening of the passage. The bridge is higher at its center than at its ends and carries a thin domed disk which shields the opening and deters wax from entering the passage.

U.S. Pat. No. 5,105,904 to Olsen illustrates a cerumen trap for hearing aids which comprises a sound channel and a plurality of perforations arranged in a stellate pattern around the sound channel which connects the sound outlet of an earpiece with the sound channel. A cylindrical component with a connecting piece which surrounds the sound channel is inserted in the hearing aid. A number of angle brackets with locking detents are arranged on the periphery of the component. The sound outlet opening can be closed off from the exterior by a cap which has a locking groove on the inner wall and which engages with the locking detents.

U.S. Pat. No. 4,870,689 to Weiss and U.S. Pat. No. 5,293,008 to Danielsen illustrate other ear wax traps. The Weiss ear wax barrier includes a housing defining a central axis of passage, as well as a plurality of projections and a variable acoustic attenuator. The projections extend inwardly from the interior surface of the housing with each projection partially occluding the cross-sectional area of the housing. The projections are intended to provide a tortuous path for ear wax migrating into the hearing aid. The variable acoustic attenuator and the projections provide a constricted passageway for damping of the acoustic response of the hearing aid. The Danielsen ear wax trap includes at least one piston or plug shaped member movable relative to another component for permitting collected ear wax to be expelled from the hearing aid.

U.S. Pat. No. 5,535,282 to Luca illustrates a hearing aid having an internal duct system which prevents ear wax from reaching an electro-acoustic transducer within the hearing aid.

Many of these devices are difficult to manufacture and unnecessarily complex. Still others are difficult for patients, particularly elderly patients, to clean.

SUMMARY OF THE INVENTION

Accordingly, it is an object of the present invention to provide a hearing aid with an improved device for trapping and collecting ear wax.

It is a further object of the present invention to provide a hearing aid with a device whose trap may be easily removed and cleaned.

It is yet a further object of the present invention to provide a hearing aid with an attachable wax collecting device which can be easily manufactured.

The foregoing objects are attained by the present invention.

An in-the-ear hearing aid in accordance with the present invention comprises a housing shaped to fit within a user's ear, and a sound passageway within the housing. The sound passageway is lined in part by a fixed tube which communicates with a receiver. A removable tube lines another portion of the sound passageway. The removable tube has an interior end which abuts the fixed tube and an ear wax trap positioned within the removable tube adjacent the interior end. In a preferred embodiment, the ear wax trap is formed by a mesh material. In accordance with the present invention, the removable tube may be removed as needed to clean the ear wax trap and thereafter reinserted into the hearing aid.

Other details of the present invention, as well as other objects and advantages attendant thereto, will be set forth in the following detailed description and the accompanying drawings wherein like reference numerals depict like elements.

DETAILED DESCRIPTION OF THE PREFERRED EMBODIMENT(S)

Figure 1:
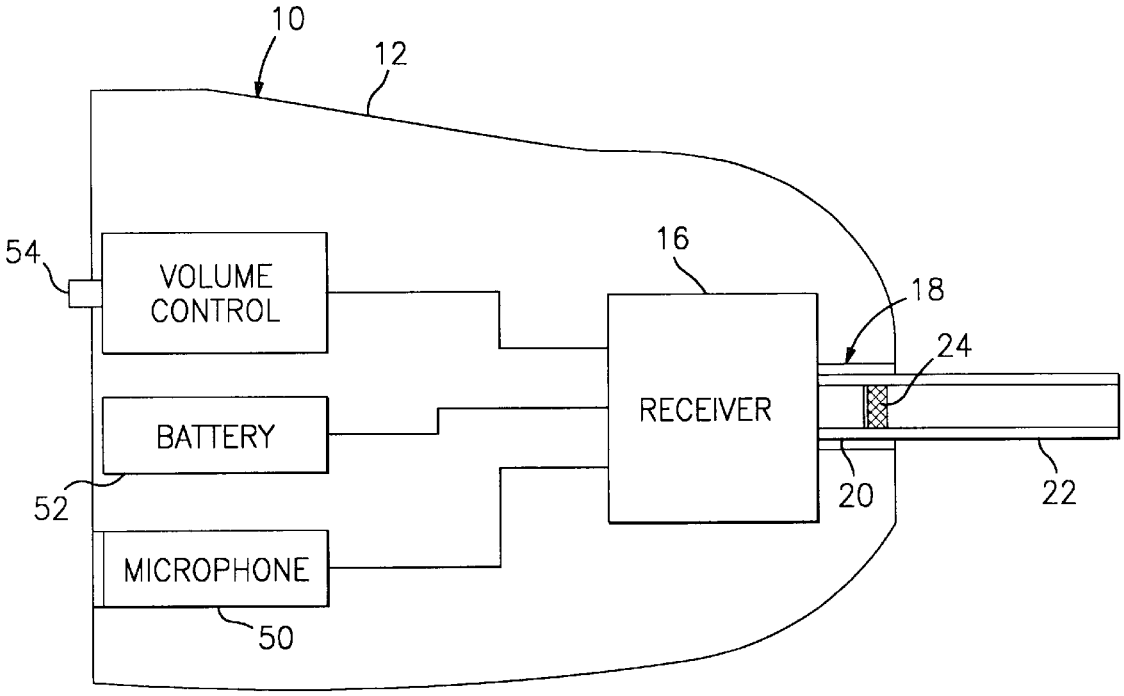
FIG. 1 is a sectional view of a portion of a hearing aid illustrating the ear wax trap of the present invention.

Referring now to the drawings, FIG. 1 illustrates a portion of an in-the-ear hearing aid 10. The hearing aid 10 has a housing 12 shaped to conform to the shape of a human's ear canal. The housing 12 may be formed from any suitable conventional material known in the art such as vinyl plastic.

The hearing aid 10 includes a number of components common to all hearing aids. For example, it includes an amplifier (not shown) and a battery assembly 52 located internally of the housing and an external volume control 54 for adjusting the sound level in the hearing aid. The external control 54 is positioned on an exterior surface of the hearing aid. Still further, the hearing aid includes a microphone 50 mounted within the housing and an acoustical connection (not shown), such as a tube, for providing access to the microphone 50 for externally arriving sound.

An acoustic transducer 16, sometimes referred to as a receiver, is mounted within a sound passageway 18 in the housing. The sound passageway 18 comprises a bore or conduit through the housing, which bore or conduit has an outlet (not shown) which communicates sound to the user's ear canal. The diameter of the sound passageway 18 is a function of the size of the hearing aid.

The transducer/receiver 16 may have a small housing or acoustic chamber within which an acoustic driver device is mounted. If present, the acoustic driver device is electrically actuated from signals from the amplifier and mechanically connected to a diaphragm that extends across and divides the receiver housing into an outer acoustic chamber portion and an inner acoustic chamber portion. The driver is typically located within the inner acoustic chamber portion.

In operation, sound impinging the hearing aid reaches the microphone 50, which microphone generates an electrical signal representative of the sound. This electrical signal is supplied to the amplifier/battery assembly. In the amplifier, the amplitude for an output signal may be adjusted by the exterior control 54. Other characteristics such as frequency response may be controlled in a similar manner. The amplifier then supplies a signal to the transducer/receiver 16.

In order for the receiver to operate properly, the sound passageway 18 must be substantially free of cerumen or ear wax. As shown in FIG. 1, the receiver 16 is connected to a cylindrical tube 20 positioned within and lining a portion of the passageway 18. The tube 20 preferably may be formed from any flexible plastic material or rubber and is open at both ends. The tube 20 may be secured to the passageway 18 by any suitable means known in the art such as an adhesive. To prevent cerumen or ear wax from entering the tube 20 and interfering with the operation of the receiver 16, a second cylindrical tube 22 is inserted in the passageway 18. The second tube 22 is also formed from a plastic material. A wax net 24, preferably formed from a sound transparent mesh material, is positioned within the tube 22, preferably adjacent the interior end 26 of the tube 22, to collect cerumen or ear wax. The net 24 may be formed from a plastic mesh material or a rewashable fabric material. The mesh portion of the net 24 is dimensioned so that cerumen or ear wax is captured rather than permitted to pass through.

Figure 2:
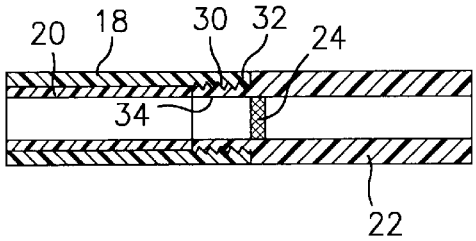
FIG. 2 is an enlarged view of a portion of a FIG. 1.

Referring now to FIG. 2, to facilitate installation and removal of the tube 22, the walls of the passageway 18 or the interior wall of the tube 20 are provided with a threaded portion 30 and the exterior wall 32 of the tube 22 is provided with a mating threaded portion 34. The use of mating threaded portions is desirable because it provides the user of the hearing aid, an audiologist, or a hearing aid dispenser with an easy way to remove the tube 22 from the sound passageway 18 in order to clean the wax net 24. Still further, it allows the user, an audiologist or a hearing aid dispenser, to easily reinstall the tube 22 after cleaning or, if necessary, to install a new tube with a new wax net. The threaded portions also help secure the tube 22 in place during normal operation of the hearing aid.

Figure 3:
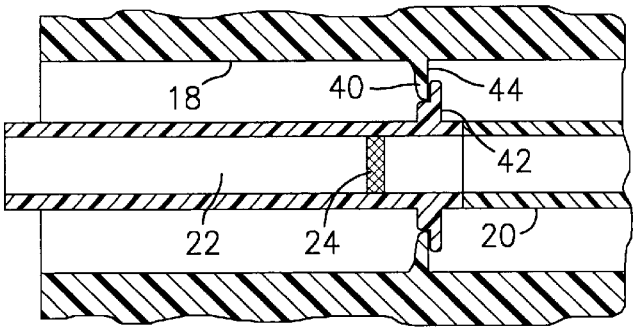
FIG. 3 illustrates an alternative system for securing the ear wax trap in place.

While it is preferred to use a screw arrangement, other mechanisms may be used to secure the tube 22 in place, while also permitting it to be removed and reinstalled as needed. FIG. 3 illustrates an alternative securement arrangement. In this arrangement, the interior wall(s) of the passageway 18 are provided with one or more cammed shoulders 40 and the exterior surface of the tube 22 is provided with one or more mating cams 42 for engaging a surface 44 of the shoulder(s) 40. Preferably, the shoulder(s) 40 only extend around a portion of the passageway wall so as to permit the tube 22 with the cam(s) 42 to be inserted into the passageway and rotated a desired amount to contact the surface 44 of each shoulder 40.

In a further embodiment, the shoulders 40 and the mating cams 42 could be formed from a flexible plastic material which allows them to be snapped together and later pulled apart.

In yet another alternative arrangement (not shown), the threads and the mating camming surfaces are omitted. Instead, an adhesive is applied to mating ends of the tubes 20 and 22. Any suitable adhesive known in the art may be used provided that it has sufficient adhesion properties to hold the tubes together.

As can be seen from the foregoing description, a simple ear wax collection device has been provided which can be used with a wide variety of hearing aids. The ear wax collection device may be easily installed and removed. When removed, the net used to collect the ear wax may be cleaned using either, a steam of air, water, or a cleaning solvent. If the net is damaged and needs to be replaced for some reason, another ear wax collection device may be easily installed. The ear wax collection device may be cleaned daily by the hearing aid user or changed periodically as needed. It further has the advantage that it is of such a size that even elderly users can clean or replace the ear wax collection device as needed.

The ear wax collection device of the present invention may come in a number of standard sizes which may be precut by an audiologist to accommodate a patient's needs. Still further, the ear wax collection device may be fabricated in a number of standard diameters which can be used as needed depending on the size of the sound passageway.

While the ear wax collection device of the present invention has been illustrated as being a continuation of the cylindrical member coming out of the receiver, it should be recognized that the cylindrical member portion of the ear wax collection device could fit over the cylindrical member coming out of the receiver.

It is apparent that there has been provided in accordance with the present invention an ear wax collection device for a hearing aid which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An in-the-ear hearing aid comprising:

a housing having an exterior shape to be fitted within an auditory canal of a human ear;

a receiver within said housing;

a sound passageway within said housing for communicating with said receiver and conducting sound to a user's ear canal, said sound passageway having a first end portion and a second end portion being opposite to said first end portion;

a first tubular member fixedly positioned within said first end portion of sound passageway, said first tubular member having a first end located adjacent said receiver and a second end remote from said receiver and further having a length which is less than the length of said sound passageway;

means positioned within said sound passageway for collecting ear wax which has entered said sound passageway, said ear wax collecting means being positioned substantially adjacent the second end of said first tubular member; and said ear wax collecting means comprising a second tubular member dimensioned to be at least partially inserted within said second end portion of sound passageway and a mesh material located substantially adjacent an interior end of said second tubular member, said interior end abutting said second end of said first tubular member.

2. The hearing aid of claim 1 further comprising:

means internal to said second end sound passageway for securing said second tubular member to a portion of said sound passageway.

3. The hearing aid of claim 2 wherein said securing means comprises a first threaded portion on an exterior surface of said second tubular member and a second threaded portion on a portion of said sound passageway for engaging said first threaded portion.

4. The hearing aid of claim 2 wherein said securing means comprises means for releasably securing said second end tubular member to said portion of said sound passageway.

5. The hearing aid of claim 1 wherein said second tubular member is formed from a plastic tube.

6. The hearing aid of claim 1 wherein said first tubular member is formed from a plastic material.

7. An in-the-ear hearing aid comprising:

a housing having an exterior shaped to fit within an auditory canal of a human ear;

a passageway machined in said housing for conducting sound, said passageway having a first end portion and a second end portion being opposite to said first end portion;

a first tube lining said first end portion of said passageway, said first tube being fixed in position and communicating with a receiver at a first end;

a second tube lining said second end portion of said passageway, said second tube having a mesh material positioned within it to collect ear wax;

said mesh material being located substantially adjacent an interior end of said second tube; and said interior end abutting a second end of said first tube.

8. The hearing aid of claim 7 wherein said second tube can be removed from said passageway to permit cleaning of said mesh material.

9. The hearing aid of claim 7 wherein said second tube is screwed into said passageway to facilitate installation and removal to permit cleaning.

10. An in-the-ear hearing aid comprising:

a housing having an exterior shaped to be fitted within an auditory canal of a human ear;

a receiver within said housing;

a sound passageway within said housing for communicating with said receiver and conducting sound to a user's ear canal, said sound passageway having a first end portion and a second end portion being opposite to said first end portion;

a first tubular member fixedly positioned within said first end portion of sound passageway, said first tubular member having a first end located adjacent said receiver and a second end remote from said receiver and further having a length which is less than the length of said sound passageway;

means positioned within said sound passageway for collecting ear wax which has entered said sound passageway, said ear wax collecting means being positioned substantially adjacent the second end of said first tubular member; and said ear wax collection means comprising a second tubular member having a first end, an open second end, and a mesh material positioned therein substantially adjacent said first end of said second tubular member, said second tubular member being at least partially positioned within said second end portion of sound passageway so that said first end of said second tubular member abuts said second end of said first tubular member and being removable from said sound passageway for cleaning by a stream of air or a cleaning solvent and being reinsertable into said sound passageway after cleaning.

11. The hearing aid of claim 7 wherein said passageway has a length and said first tube has a length less than the length of said passageway.

12. The hearing aid of claim 7 further comprising:

said receiver positioned within said housing; and said second tube having an open second end remote from the interior end.

13. The hearing aid of claim 12 wherein said first tube and said second tube are aligned along a common axis.

14. The hearing aid of claim 7 wherein said second tube projects beyond said housing so that an open end of said tube is located externally of said housing.

* * * * *